United States Patent [19]

Lewis

[11] 4,285,155

[45] Aug. 25, 1981

[54] TOY SHAVING SET FOR A DOLL

[75] Inventor: J. Stephen Lewis, Pacific Palisades, Calif.

[73] Assignee: Mattel, Inc., Hawthorne, Calif.

[21] Appl. No.: 87,591

[22] Filed: Oct. 22, 1979

[51] Int. Cl.[3] ..... A63H 33/00

[52] U.S. Cl. ..... 46/1 R; 46/116

[58] Field of Search ..... 46/1 R, 116, , 1 F, 46/135 R; 35/29 E, 59; 132/80 R, 79 A

[56] References Cited

U.S. PATENT DOCUMENTS

| | | | |
|---|---|---|---|
| 1,453,014 | 4/1923 | Kohn | 132/80 R |
| 1,557,612 | 10/1925 | Post | 46/1 R |
| 1,869,860 | 8/1932 | Natkiel | 132/80 R |
| 3,783,553 | 1/1974 | Goozner | 46/116 |
| 3,863,386 | 2/1975 | Kinberg | 35/62 X |

OTHER PUBLICATIONS

"Lil Shaver", Kusan, Inc. Catalog, Mar. 1965, Nashville, Tenn.

*Primary Examiner*—Gene Mancene
*Assistant Examiner*—Mickey Yu

[57] ABSTRACT

A toy shaving kit to be used with a doll including a toy razor and a felt tip pen containing water soluble ink for applying "hair" to the face of a doll. The toy razor includes a holder and a face-conforming sponge blade which may be dipped in water and applied to "shave" the "hair" from the face of the doll.

1 Claim, 7 Drawing Figures

TOY SHAVING SET FOR A DOLL

BACKGROUND OF THE INVENTION

The background of the invention will be discussed in two parts:

1. Field of the Invention

This invention relates to toys and, more particularly, to a toy razor which may be used in conjunction with a doll so that the doll may be made to appear to shave.

2. Description of the Prior Art

There have been a myriad of toys developed over the years for use by children. The value of a toy may be enhanced if a child may use it to emulate an adult, for children are always eager to do those things which they see adults doing.

Other characteristics of a toy which enhance its value are that it is easy for a child to use, durable, safe for a child to use, and inexpensive.

It is an object of this invention to provide a new and improved toy.

It is another object of this invention to provide a toy which may be used by a child to emulate shaving by an adult male.

SUMMARY OF THE INVENTION

The foregoing and other objects of the invention are accomplished by a toy set which includes a felt tip pen having a water soluble ink of a tone such as to simulate the beard of an adult male doll, and a toy razor which includes a handle and a face-conforming portion held by such handle. The pen may be used to apply a beard, a mustache, sideburns, or any combination of the above to a doll. The razor may be dipped in water and used to "shave " the "hair" from the face of the doll. The face-conforming portion which may be a sponge-like material in a preferred embodiment is adapted to be rinsed in water so that the removal of the "hair" emulates shaving by an adult male.

Other objects, features, and advantages of the invention will become apparent form a reading of the specification taken in conjunction with the drawings in which like reference numerals refer to like elements in the several views.

DESCRIPTION OF THE PREFERRED EMBODIMENT

Figure 1:
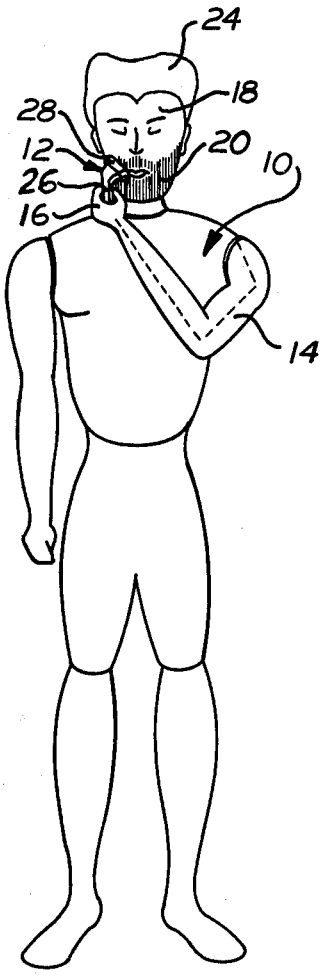
FIG. 1 is a view showing a doll holding in its hand a toy razor constructed in accordance with this invention.
Figure 2:
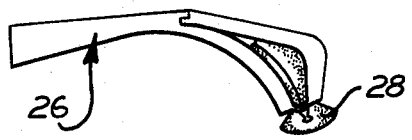
FIG. 2 is a side view of a toy razor constructed in accordance with this invention.
Figure 3:
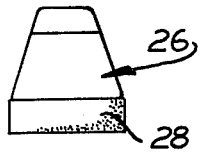
FIG. 3 is a front view of the toy razor shown in FIG. 2.
Figure 4:
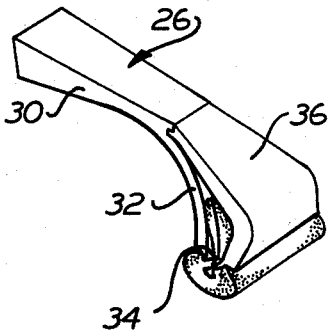
FIG. 4 is a perspective view of the toy razor shown in FIG. 2.

Referring now to the drawings, and more particularly, to FIG. 1, there is shown a front view of a toy doll 10 holding a toy razor 12 constructed in accordance with the invention. The doll 10 may be any of a number of toy dolls. For example, the doll may be one of the well-known action figures currently available on the market constructed of various plastic materials and having a height of approximately 28 centimeters. Such dolls are quite well known and are available throughout the world. It is especially desirable that the doll 10 which is utilized in practicing the invention have an arm 14 which rotates at the shoulder and is bendable at the elbow. Furthermore, it is desirable that such a doll be provided with a hand 16 which is formed to grip the razor 12. Using such a doll, the razor 12 may be placed in the hand 16, the arm 14 bent to conform with the position shown in FIG. 1, and the razor 12 moved over the face 18 of the doll to remove the beard illustrated at 20.

Figure 7:
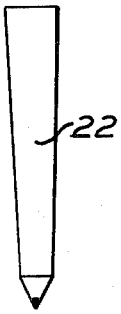
FIG. 7 is a view of the felt tipped pen which may be used in the practice of the invention.

The beard and mustache 20 may be applied to the doll 10 by application of a felt tipped pen, such as the pen 22 shown in FIG. 7, carrying a water soluble ink. The ink carried by the pen 22 is preferably of a shade adapted to match the hair 24 of the particular doll so that, when applied, the doll 10 will appear to have a beard and mustache.

The toy razor 12 includes a holder 26, which may be constructed in the shape of an adult's razor from a moldable plastic material, and a face contouring portion 28, which is preferably constructed of a material which will absorb a liquid such as water and which is adapted to conform to the face of the doll 10. In the preferred embodiment, the face contouring portion 28 which emulates a razor blade is constructed of a cellular sponge material (such a plastic) adapted to absorb water. As may be better visualized from FIGS. 2 through 6, the holder 26 includes a first extended handle portion 30 which is relatively thick and is shaped so that it may be gripped by the doll 10 as a razor is gripped or by a child. The handle 30 is connected to portion 32 which is thinner (as viewed from the side) and wider (as viewed from the top) than handle 30. Portion 32 is molded in an arcuate curve downward from the handle 30 and is adapted to form one side of a holder for the face contouring portion 28.

The side portion 32 is connected by a pair of webs 34 to a second holder side portion 36. As may be seen, the webs 34 are quite thin as viewed from both the side and top, and consequently, bend very easily as contrasted to the portions 32 and 36. They also are much more limber than the protions 32 and 36. Consequently, the portion 36, which is molded to have a form adapted to curve over the portion 32, pivots about the webs 34, clamps over the face contouring portion 28, and snaps to the handle 30 by means of a projection 38 which fits into a receptacle 40. The provision of the projection 38 and receptacle 40 allows the use of interchangeable "blades" (i.e., the face conforming portion 28) by the child. As these blades are used, they may be replaced just as are those of a parent.

Figure 5:
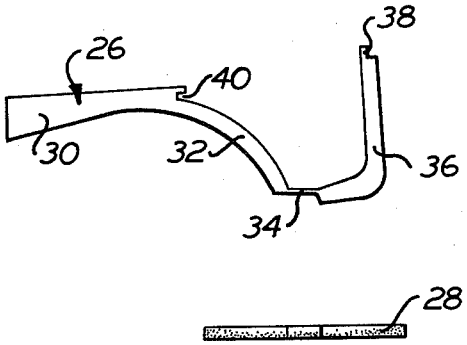
FIG. 5 is a side view of the toy razor shown in FIG. 2 opened so that it may be fitted with a new face conforming portion.
Figure 6:
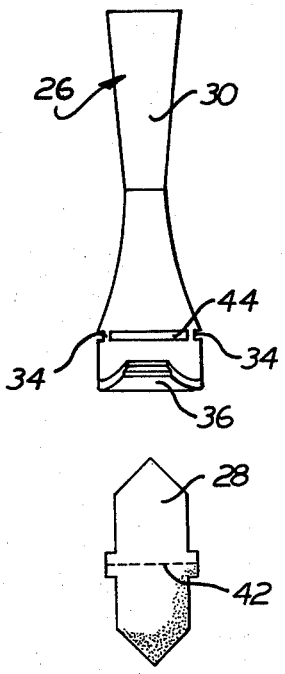
FIG. 6 is a top view of the open toy razor shown in FIG. 5 and the face conforming portion therefore.

As may be seen in FIGS. 5 and 6, the face contouring portion 28 may be constructed of a flat, thin cellular material which widens at the center, is folded along a dotted line 42, and has its ends inserted through an aperture 44 between the webs 34 and separating the side portions 32 and 36. When so inserted, the wider middle of the portions 28 extends outwardly from the holder 26 to provide a relatively broad sponge-like exterior portion which may be dipped in water and rubbed over the face 20 of the doll 10 to remove water soluble ink placed thereon by a child from the pen 22. The extension of the portion 28 may be made sufficient so that it easily conforms to the contours of the face 18 of any particular doll 10 with which the razor 12 may be used. In an alternative form, a thicker flat cellular material may be used and clamped unfolded between portions 32 and 36. Using such a toy razor 12, a child will find it easy to emulate the removal of a beard, mustache, or sideburns on a doll thereby emulating the actions of a male adult shaving.

While there has been shown and described the preferred embodiment, it is to be understood that various other adaptations and modifications may be made which fall within the spirit and scope of the invention.

What is claimed is:

1. A toy razor comprising a handle, a first arcuate member connected to the handle, a second member adapted to mate with the first arcuate member to provide a holder, means adapted to rotate one end of the second member about the end of the first arcuate member opposite the handle, means for latching the second member to the first member, and a cellular sponge held between the first and second members to project therefrom.

* * * * *